US007719176B2

(12) United States Patent
Park

(10) Patent No.: US 7,719,176 B2
(45) Date of Patent: May 18, 2010

(54) SPACER CONFIGURED TO PREVENT ELECTRIC CHARGES FROM BEING ACCUMULATED ON THE SURFACE THEREOF AND ELECTRON EMISSION DISPLAY INCLUDING THE SPACER

(75) Inventor: Chul-Ho Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 613 days.

(21) Appl. No.: 11/580,838

(22) Filed: Oct. 16, 2006

(65) Prior Publication Data

US 2010/0060135 A1 Mar. 11, 2010

(30) Foreign Application Priority Data

Oct. 31, 2005 (KR) ..... 10-2005-0103529

(51) Int. Cl.
*H01J 1/88* (2006.01)
*H01J 19/42* (2006.01)

(52) U.S. Cl. ..... 313/256; 313/240; 313/259; 313/495; 313/409; 313/452; 313/414; 313/257; 313/258; 313/292

(58) Field of Classification Search ..... 313/495–497, 313/306, 309–310, 346, 351, 355, 293–304, 313/238–292
See application file for complete search history.

(56) References Cited

U.S. PATENT DOCUMENTS 5,675,212 A 10/1997 Schmid et al.
5,726,529 A 3/1998 Dean et al.
6,153,973 A * 11/2000 Shibata et al. ..... 313/495
6,265,822 B1 * 7/2001 Kuroda et al. ..... 313/495
6,353,280 B1 * 3/2002 Shibata et al. ..... 313/292
6,420,824 B1 7/2002 Abe et al.
6,441,544 B1 8/2002 Ando et al.
6,489,718 B1 12/2002 Schmid et al.
6,506,087 B1 1/2003 Fushimi et al.
6,512,329 B1 1/2003 Mitsutake et al.
6,534,911 B1 3/2003 Ando
6,541,905 B1 4/2003 Fushimi et al.
6,566,794 B1 * 5/2003 Miyazaki ..... 313/292

(Continued)

FOREIGN PATENT DOCUMENTS

CN 1223384 A 7/1999

(Continued)

OTHER PUBLICATIONS

European Search Report corresponding to European Patent Application No. 06123226.0, issued on Apr. 4, 2007.

(Continued)

*Primary Examiner*—Sikha Roy
*Assistant Examiner*—Jose M Diaz
(74) *Attorney, Agent, or Firm*—Robert E. Bushnell, Esq.

(57) ABSTRACT

A spacer, disposed between first and second substrates of an electron emission display, includes a main body, a resistive layer arranged on a side surface of the main body, a secondary electron emission preventing layer arranged on the resistive layer, and a diffusion preventing layer arranged between the resistive layer and the secondary electron emission layer. The diffusion preventing layer prevents interdiffusion between the resistive layer and the secondary electron emission preventing layer.

16 Claims, 4 Drawing Sheets

U.S. PATENT DOCUMENTS

| | | | | |
|---|---|---|---|---|
| 6,657,368 | B1 * | 12/2003 | Kosaka et al. | 313/310 |
| 6,777,868 | B1 * | 8/2004 | Kosaka et al. | 313/495 |
| 6,802,753 | B1 | 10/2004 | Ando et al. | |
| 6,828,722 | B2 | 12/2004 | Ueda et al. | |
| 6,847,161 | B2 | 1/2005 | Ito | |
| 6,861,798 | B1 | 3/2005 | Pan et al. | |
| 6,927,533 | B1 | 8/2005 | Ito et al. | |
| 7,249,989 | B2 | 7/2007 | Hayama | |
| 7,298,074 | B2 | 11/2007 | Yamazaki | |
| 7,365,483 | B2 * | 4/2008 | Chi et al. | 313/497 |
| 7,378,788 | B2 | 5/2008 | Ando | |
| 7,429,821 | B2 | 9/2008 | Ando | |
| 7,459,841 | B2 | 12/2008 | Kojima et al. | |
| 2001/0024085 | A1 | 9/2001 | Abe et al. | |
| 2002/0031974 | A1 | 3/2002 | Ito et al. | |
| 2002/0047512 | A1 | 4/2002 | Shinjo et al. | |
| 2002/0079829 | A1 | 6/2002 | Ando et al. | |
| 2002/0158571 | A1 | 10/2002 | Ando | |
| 2003/0141803 | A1 | 7/2003 | Fushimi | |
| 2004/0070325 | A1 * | 4/2004 | Nakata | 313/292 |
| 2004/0161997 | A1 | 8/2004 | Ito et al. | |
| 2004/0245916 | A1 | 12/2004 | Hiroike et al. | |
| 2005/0003730 | A1 | 1/2005 | Ando et al. | |
| 2005/0146260 | A1 * | 7/2005 | Yamazaki | 313/292 |
| 2005/0280350 | A1 | 12/2005 | Seon | |
| 2007/0090741 | A1 | 4/2007 | Jung | |
| 2007/0247047 | A1 * | 10/2007 | Niibori et al. | 313/292 |
| 2009/0072695 | A1 | 3/2009 | Hiroike et al. | |

FOREIGN PATENT DOCUMENTS

| | | | |
|---|---|---|---|
| CN | 1574178 | | 2/2005 |
| CN | 100570801 | | 12/2009 |
| EP | 0 810 626 | | 12/1997 |
| EP | 0 851 458 | | 1/1998 |
| EP | 1 137 041 | | 9/2001 |
| EP | 1 152 452 | | 11/2001 |
| EP | 1 484 782 | | 12/2004 |
| EP | 1 526 562 | | 4/2005 |
| EP | 1 696 465 | | 8/2006 |
| JP | 0922649 | | 1/1997 |
| JP | 10-240793 | | 9/1998 |
| JP | 10-241606 | | 9/1998 |
| JP | 2005-019394 | | 9/1998 |
| JP | 11007910 | A * | 1/1999 |
| JP | 2000-082426 | | 3/2000 |
| JP | 2000-113804 | | 4/2000 |
| JP | 2000-173510 | | 6/2000 |
| JP | 2000173510 | A * | 6/2000 |
| JP | 2000-248267 | | 9/2000 |
| JP | 2003-229057 | | 8/2003 |
| JP | 2007-128886 | | 5/2007 |
| WO | WO 9602933 | | 2/1996 |

OTHER PUBLICATIONS

U.S. Appl. No. 11/580,837, filed Oct. 16, 2006, Kang-Sik Jung.

Office action from Japanese Patent Office issued in Applicant's corresponding Japanese Patent Application No. 2006-289793 dated Oct. 6, 2009.

European Search Report corresponding to European Patent Application No. 06122894.6-2208, issued on Feb. 20, 2007.

* cited by examiner

SPACER CONFIGURED TO PREVENT ELECTRIC CHARGES FROM BEING ACCUMULATED ON THE SURFACE THEREOF AND ELECTRON EMISSION DISPLAY INCLUDING THE SPACER

CLAIM OF PRIORITY

This application makes reference to, incorporates the same herein, and claims all benefits accruing under 35 U.S.C. §119 from an application for SPACER AND ELECTRON EMISSION DISPLAY DEVICE HAVING THE SAME, earlier filed in the Korean Intellectual Property Office on the 31 Oct. 2005 and there duly assigned Serial No. 10-2005-0103529.

BACKGROUND OF THE INVENTION

1. Field of the Invention

The present invention relates to a spacer and an electron emission display including the spacer. More particularly, the present invention relates to a spacer that is configured to prevent electric charges from being accumulated on the surface thereof and an electron emission display including the spacer.

2. Description of the Related Art

Generally, electron emission elements are classified into those using hot cathodes as an electron emission source, and those using cold cathodes as the electron emission source. There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

A typical electron emission element includes an electron emission region and driving electrodes for controlling the electron emission of the electron emission region. The electron emission region emits electrons according to the voltage supplied to the driving electrodes. The electron emission elements are arrayed on a first substrate to form an electron emission device. The first substrate of the electron emission device is disposed to face a second substrate on which a light emission unit having a phosphor layer and an anode electrode are provided. The first and second substrates are sealed together at their peripheries using a sealing member and the inner space between the first and second substrates is exhausted to form an electron emission display having a vacuum envelope.

In addition, a plurality of spacers is disposed in the vacuum envelope to prevent the substrates from being damaged or broken by a pressure difference between the inside and outside of the vacuum envelope.

The spacers are generally formed of a nonconductive material, such as ceramic or glass, and disposed to correspond to non-emission areas between the phosphor layers so as not to interfere with traveling paths of the electrons emitted from the electron emission device toward the phosphor layers.

However, when the electrons emitted from the electron emission device travel toward the corresponding phosphor layers, an electron beam-diffusing phenomenon can occur due to a high electric field caused by the anode electrode. The electron beam-diffusing phenomenon cannot be completely suppressed even when a focusing electrode is provided.

Due to the electron beam-diffusing phenomenon, some of the electrons cannot land on the corresponding phosphor layers but collide with the spacers. The spacers, formed of glass or ceramic, have an electron emission coefficient higher than 1. Therefore, when the electrons collide with the spacers, many secondary electrons are emitted from the spacers and thus, the spacers are positively charged. When the spacers are charged, the electric field around the spacers varies to distort the electron beam path.

The electron beam distortion causes the electrons emitted from the electron emission device to move toward the spacers. In this case, a visible spacer problem can occur where the spacers are observed on a screen by a user, thereby deteriorating the display quality.

SUMMARY OF THE INVENTION

The present invention provides a spacer that can suppress an electron beam distortion to prevent the display quality from being deteriorated, and an electron emission display having the spacer.

In one exemplary embodiment of the present invention, a spacer is provided including: a main body; a resistive layer arranged on a side surface of the main body; a secondary electron emission preventing layer arranged on the resistive layer; and a diffusion preventing layer arranged between the resistive layer and the secondary electron emission layer, the diffusion preventing layer adapted to prevent interdiffusion between the resistive layer and the secondary electron emission preventing layer.

The diffusion preventing layer preferably has a resistivity lower than that of the secondary electron emission preventing layer but higher than that of the resistive layer. The diffusion preventing layer preferably includes either a metal nitride layer or a metal oxide layer. The metal nitride layer preferably includes either Cr or Ti. The metal oxide layer preferably includes a material selected from a group consisting of Cr, Ti, Zr, and Hf.

The resistive layer preferably includes a highly resistive material. The highly resistive material preferably includes a metal selected from a group consisting of Ag, Ge, Si, Al, W, Au, or an alloy thereof and a compound selected from a group consisting of $Si_3N_4$, AlN, PtN, GeN, or a combination thereof.

The secondary electron emission preventing layer preferably includes a material having a secondary electron emission coefficient within a range of 1 to 1.8. The secondary electron emission preventing layer preferably includes a material selected from a group consisting of diamond-like carbon, $Nd_2O_3$, and $Cr_2O_3$.

The spacer preferably further includes contact electrodes arranged on respective top and bottom surfaces of the main body. The contact electrodes preferably include a material selected from a group consisting of Ni, Cr, Mo, and Al.

In another exemplary embodiment of the present invention, an electron emission display is provided including: first and second substrates adapted to form a vacuum envelope; an electron emission unit arranged on the first substrate; a light emission unit arranged on the second substrate; and a spacer disposed between the first and second substrates, the spacer including: a main body; a resistive layer arranged on a side surface of the main body; a secondary electron emission preventing layer arranged on the resistive layer; and a diffusion preventing layer arranged between the resistive layer and the secondary electron emission layer and adapted to prevent interdiffusion between the resistive layer and the secondary electron emission preventing layer.

The electron emission unit preferably includes electron emission regions and electrodes adapted to drive the electron emission regions. The electron emission regions preferably include a material selected from a group consisting of carbon nanotubes, graphite, graphite nanofibers, diamonds, diamond-like carbon, fullerene ($C_{60}$), silicon nanowires, and a combination thereof.

The electron emission display preferably further includes a focusing electrode arranged between the first and second substrates.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

The present invention is described more fully below with reference to the accompanying drawings, in which exemplary embodiments of the present invention are shown. The present invention can, however, be embodied in many different forms and should not be construed as being limited to the embodiments set forth herein; rather these embodiments are provided so that this disclosure will be thorough and complete, and will fully convey the concept of the present invention to those skilled in the art.

Figure 1A:
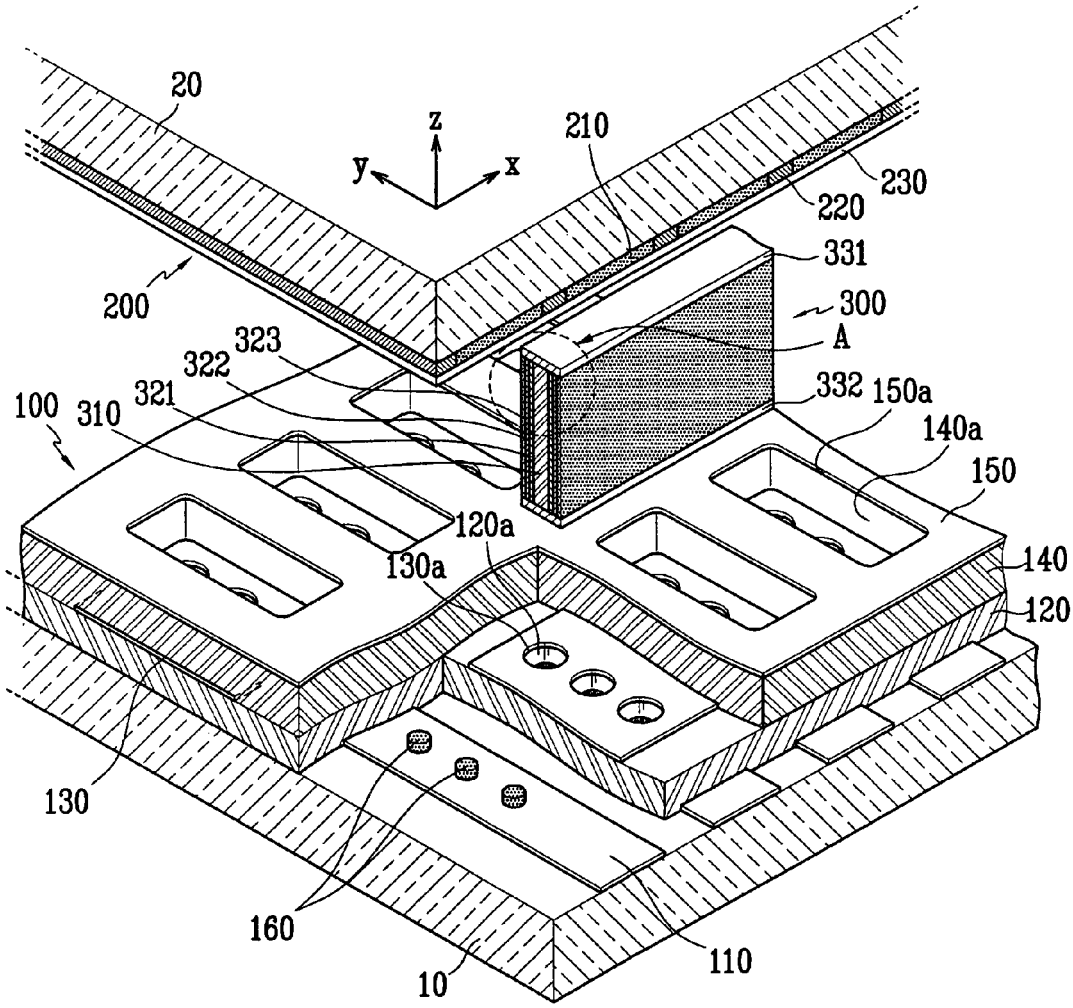
FIG. 1A is a partial exploded perspective view of an electron emission display according an embodiment of the present invention.
Figure 1B:
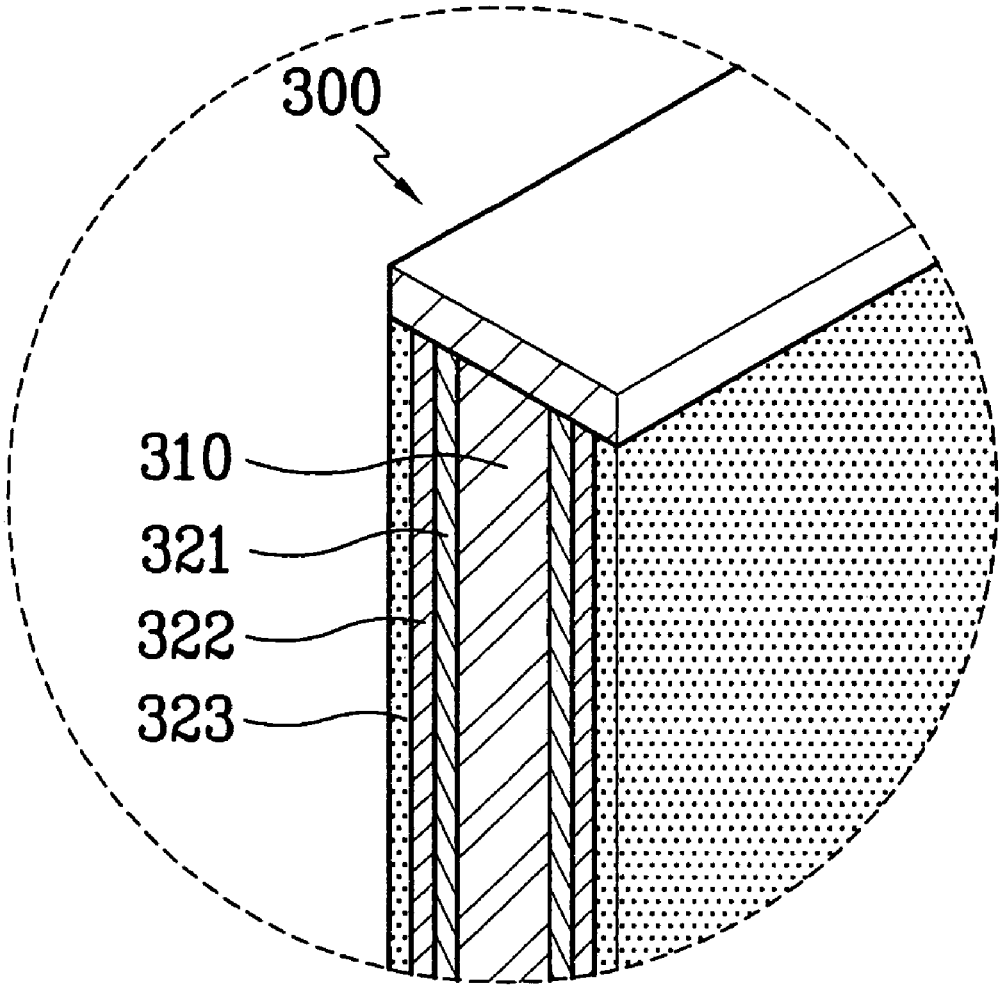
FIG. 1B is an enlarged view of a portion A of FIG. 1A.
Figure 2:
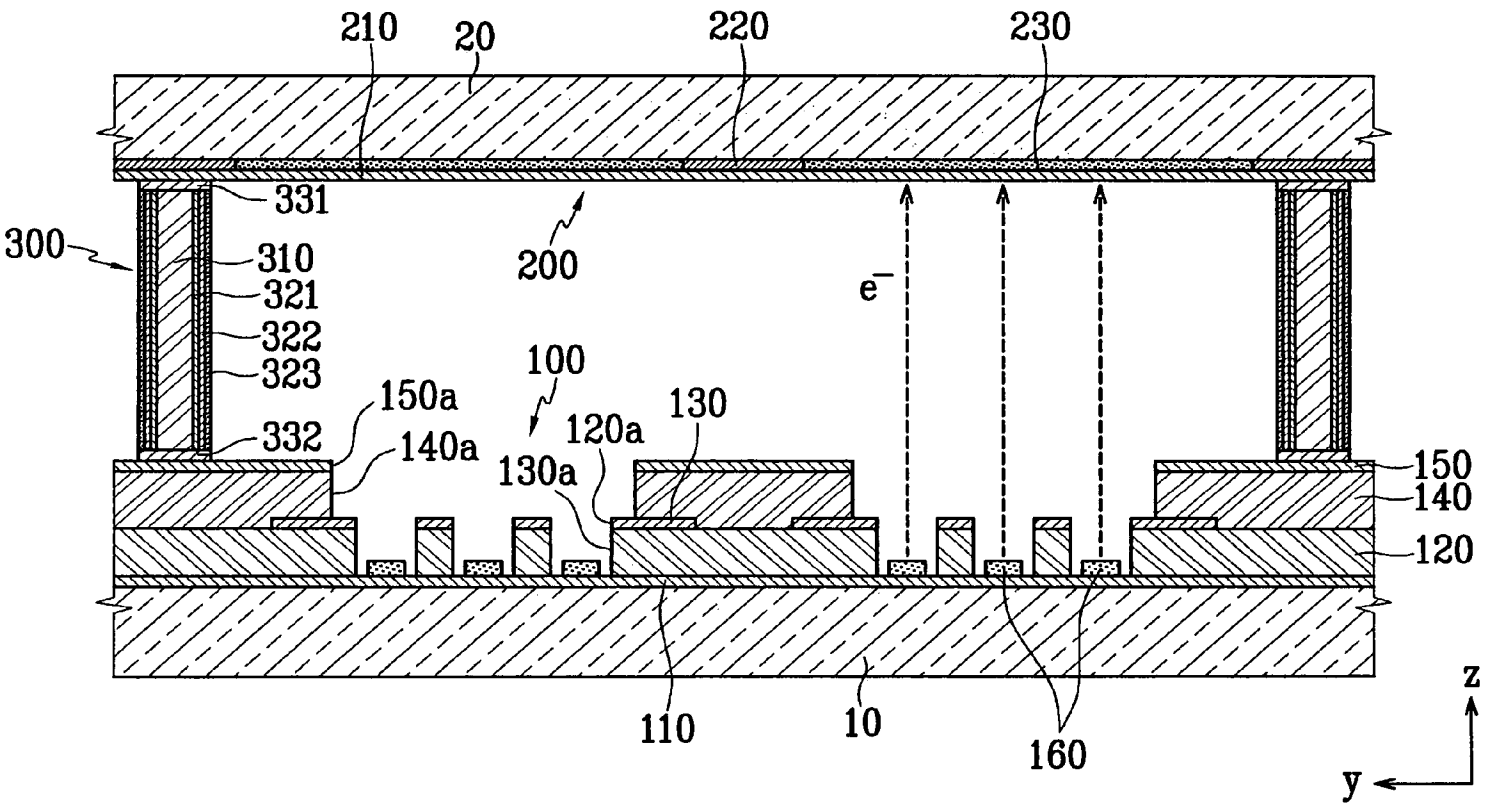
FIG. 2 is a partial sectional view of the electron emission display of FIG. 1.

FIGS. 1A, 1B and 2 are views of an electron emission display according an embodiment of the present invention. In this embodiment, an electron emission display having an array of FEA elements is illustrated.

Referring to FIGS. 1A and 2, an electron emission display includes first and second substrates 10 and 20 facing each other and spaced apart by a predetermined interval.

An electron emission unit 100 for emitting electrons and a light emission unit 200 for emitting visible light using the electrons emitted from the electron emission unit 100 are respectively provided on facing surfaces of the first and second substrates 10 and 20.

That is, a plurality of cathode electrodes (first electrodes) 110 are arranged on the first substrate 10 in a stripe pattern extending in a direction (a direction of a y-axis in FIG. 1) and a first insulation layer 120 is arranged on the first substrate 10 to cover the cathode electrodes 110. A plurality of gate electrodes (second electrodes) 130 are arranged on the first insulation layer 120 in a stripe pattern extending in a direction (a direction of an x-axis in FIG. 1) to cross the cathode electrodes 110 at right angles.

One or more electron emission regions 160 are arranged on the cathode electrode at each crossed region of the gate and cathode electrodes 110 and 130. Openings 120*a* and 130*a* corresponding to the electron emission regions 160 are arranged in the first insulation layer 120 and the gate electrodes 130 to expose the electron emission regions 160.

The electron emission regions 160 are formed of a material which emits electrons when an electric field is applied thereto in a vacuum, such as a carbonaceous material or a nanometer-sized material. For example, the electron emission regions 160 can be formed of carbon nanotubes, graphite, graphite nanofibers, diamonds, diamond-like carbon, fullerene ($C_{60}$), silicon nanowires, or a combination thereof through a screen-printing, direct growth, chemical vapor deposition, or sputtering process.

In FIG. 1A, three electron emission regions 160 are arranged in series along the cathode electrodes 110 at each crossed region and each of the electron emission regions 160 have a flat, circular top surface. The arrangement and top surface shape of the electron emission regions are, however, not limited thereto.

In the foregoing description, although the gate electrodes 130 are arranged above the cathode electrodes 110 with the first insulation layer 120 interposed therebetween, the present invention is not limited thereto. That is, the gate electrodes 130 can be disposed under the cathode electrodes 110 with the first insulation layer interposed therebetween. In such a case, the electron emission regions 160 can be arranged on sidewalls of the cathode electrodes on the first insulation layer.

One cathode electrode 110, one gate electrode 130, the first insulation layer 120, and the three electron emission regions 160 form one electron emission element. That is, a plurality of the electron emission elements is arrayed on the first substrate 10 to form an electron emission device.

In addition, a second insulation layer 140 is arranged on the first insulation layer 120 while covering the gate electrodes 130 and a focusing electrode 150 is arranged on the second insulation layer 140. Openings 140*a* and 150*a* through which electron beams pass are arranged in the second insulation layer 140 and the focusing electrode 150. The openings 140*a* and 150*a* are arranged to correspond to one electron emission element to generally focus the electrons emitted from the electron emission regions 150 at each electron emission element 160. The greater a level difference between the focusing electrode 150 and the electron emission regions 160, the higher the focusing efficiency. Therefore, it is preferable that a thickness of the second insulation layer 140 is greater than that of the first insulation layer 120.

In addition, the focusing electrode 150 can be arranged on an entire surface of the second insulation layer 140 or can be arranged in a predetermined pattern having a plurality of sections corresponding to the respective electron emission elements.

The focusing electrode 150 can be formed of a conductive layer deposited on the second insulation layer 140 or a metal plate having openings 150*a*.

Phosphor layers 210 and a black layer 220 are arranged on a surface of the second substrate 20 facing the first substrate 10. An anode electrode 230 formed of a conductive material, such as aluminum, is arranged on the phosphor and black layers 210 and 220. The anode electrode 230 functions to heighten the screen luminance by receiving a high voltage required for accelerating the electron beams and reflecting the visible light rays radiated from the phosphor layers 210 to the first substrate 10 toward the second substrate 20.

Alternatively, the anode electrode 230 can be formed of a transparent conductive material, such as Indium Tin Oxide (ITO), instead of the metallic material. In such a case, the anode electrode 230 is placed on the second substrate 20 and the phosphor and black layers 210 and 220 are arranged in a predetermined pattern on the anode electrode 230. Alternatively, the anode electrode 230 can be arranged in a predetermined pattern corresponding to the pattern of the phosphor and black layers 210 and 220.

Alternatively, the anode electrode 230 is formed of the transparent material and a metal layer for enhancing the luminance is arranged on the second substrate 20.

The phosphor layers 210 can be arranged to correspond to the respective unit pixel regions defined on the first substrate 10. Alternatively, the phosphor layers 210 can be arranged in a stripe pattern extending along a vertical direction (the y-axis of FIG. 1) of the screen. The black layer 220 is formed of a non-transparent material, such as chrome or chromic oxide.

In the above-described electron emission display, the phosphor layers 210 are arranged to correspond to the respective electron emission elements 160. One phosphor layer 210 and one electron emission element 160 that correspond to each other define one pixel of the electron emission display.

Disposed between the first and second substrates 10 and 20 are spacers 300 for uniformly maintaining a gap between the first and second substrates 10 and 20. The spacers 300 are arranged at a non-emission region on which the black layer 220 is disposed. In this embodiment, a wall-type spacer is exampled.

Referring to FIG. 1B, the spacer 300 includes a main body 310 formed of a non-conductive material, such as glass or ceramic, a resistive layer 321 covering side surfaces of the main body 310, a diffusion preventing layer 322 arranged on the resistive layer 321, and a secondary electron emission preventing layer 323 arranged on the diffusion preventing layer 322.

The resistive layer 321 provides a traveling path for the electric charges that will be charged on the spacer 300 to prevent the electric charges from being accumulated on the spacer 300. The resistive layer 321 is formed of a high resistive material having a relatively low electric conductivity. For example, the high resistive material includes a metal selected from a group consisting of Ag, Ge, Si, Al, W, and Au, or an alloy thereof and a compound selected from a group consisting of $Si_3N_4$, AlN, PtN, and GeN, or a combination thereof. Preferably, the high resistive material is selected from a group consisting of Ag/$Si_3N_4$, Ge/AlN, Si/AlN, Al/PtN, W/GeN, and Au/AlN.

The secondary electron emission preventing layer 323 minimizes the emission of the secondary electrons from the spacer 300 when the electrons collide with the spacer 300. The secondary electron emission preventing layer 323 is formed of a material having a secondary electron emission coefficient within the range of 1 to 1.8, such as diamond-like carbon, $Nd_2O_3$, or $Cr_2O_3$.

The diffusion preventing layer 322 prevents the interdiffusion, which is generated between the resistive layer 321 and the secondary electron emission preventing layer 323 due to the heat applied during the sealing process for manufacturing the vacuum envelope by sealing the first and second substrates 10 and 20, thereby preventing the surface reaction between the resistive layer 321 and the secondary electron emission preventing layer 323.

The diffusion preventing layer 322 is formed a material having a resistivity lower than that of the secondary electron emission preventing layer 323 but higher than that of the resistive layer 321. For example, the diffusion preventing layer 322 can be formed of a metal oxide material selected from a group consisting of CrN, TiN, $CrO_2$, $ZrO_2$, $HfO_2$, and $TiO_2$.

When the resistivity of the diffusion preventing layer 322 is lower than that of the resistive layer 321, the current flows through the diffusion preventing layer 322 rather than the resistive layer 321 and thus the current flow of the resistive layer 321 cannot be effectively realized. In addition, when the resistivity of the diffusion preventing layer 322 is higher than that of the secondary electron emission preventing layer 323, the electric charges can be accumulated on the diffusion preventing layer 322. Therefore, it is preferable that the resistivity of the diffusion preventing layer 322 is less than that of the secondary electron emission preventing layer 323 but higher than that of the resistive layer 321.

Contact electrode layers 331 and 332 can be further arranged on top and bottom surfaces of the spacer. The contact electrode layers 331 and 332 can be formed of Cr, Ni, Mo, or Al (see FIG. 2).

Since the spacer 330 is electrically connected to the anode and focus electrodes 230 and 150 via the contact electrode layers 331 and 332, the electrons charged on the spacer 300 are removed.

In addition, the spacer 300 can be formed in a cylinder-type having a circular-shape or cross-shape section in addition to the wall-type.

After the spacers 300 are disposed between the first and second substrates 10 and 20, the first and second substrates 10 and 20 are sealed together at their peripheries using a sealing member through a high temperature thermal-bonding process and an inner space defined between the first and second substrate 10 and 20 is exhausted to form a vacuum envelope.

Since the surface reaction between the resistive layer 321 and the electron emission preventing layer 322 is prevented by the diffusion preventing layer 322 of the spacer 300, the deterioration of the layer properties of the resistive layer 321 and secondary electron emission preventing layer 322 can be prevented.

The above-described electron emission display is driven when a predetermined voltage is supplied to the cathode, gate, focusing, and anode electrodes 110, 130, 150, and 230. For example, one of the cathode and gate electrodes 110 and 130 serves as scan electrodes receiving a scan drive voltage and the other functions as data electrodes receiving a data drive voltage. The focusing electrode 150 receives a negative voltage of several to tens volts. The anode electrode 230 receives a positive voltage of, for example, hundreds through thousands volts.

Electric fields are formed around the electron emission regions where a voltage difference between the cathode and gate electrodes 110 and 130 is equal to or higher than a threshold value and thus, electrons are emitted from the electron emission regions. The emitted electrons are converged while passing through the openings 150*a* of the focusing electrode 150 and strike the corresponding phosphor layers 210 by the high voltage supplied to the anode electrode 230, thereby exciting the phosphor layers 210.

During the above process, the electron beam is diffused despite the operation of the focusing electrode 150. Therefore, some of the electrons cannot land on the corresponding phosphor layer 210 but collide with the spacer 300. Even when the electrons collide with the spacer 300, the secondary electron emission from the spacer 300 can be minimized by the secondary electron emission preventing layer 323. In addition, even when the surface of the spacer 300 is charged with electric charges, the electric charges transfer to away from the spacer 300 by the resistive layer 321 and contact electrode layers 331 and 332 and thus the electric charges are not accumulated on the surface of the spacer 300.

As a result, in the electron emission display, the electron beam distortion caused by the electric field distortion around the spacer 300 can be prevented.

Although an electron emission display having Field Emitter Array (FEA) elements is discussed in the above exemplary embodiment, the present invention is not limited to this example. That is, the present invention can be applied to an electron emission display having other types of electron emission elements, such as Surface Conduction Emitter (SCE) elements, Metal-Insulator-Metal (MIM) elements or Metal-Insulator-Semiconductor (MIS) elements.

Figure 3:
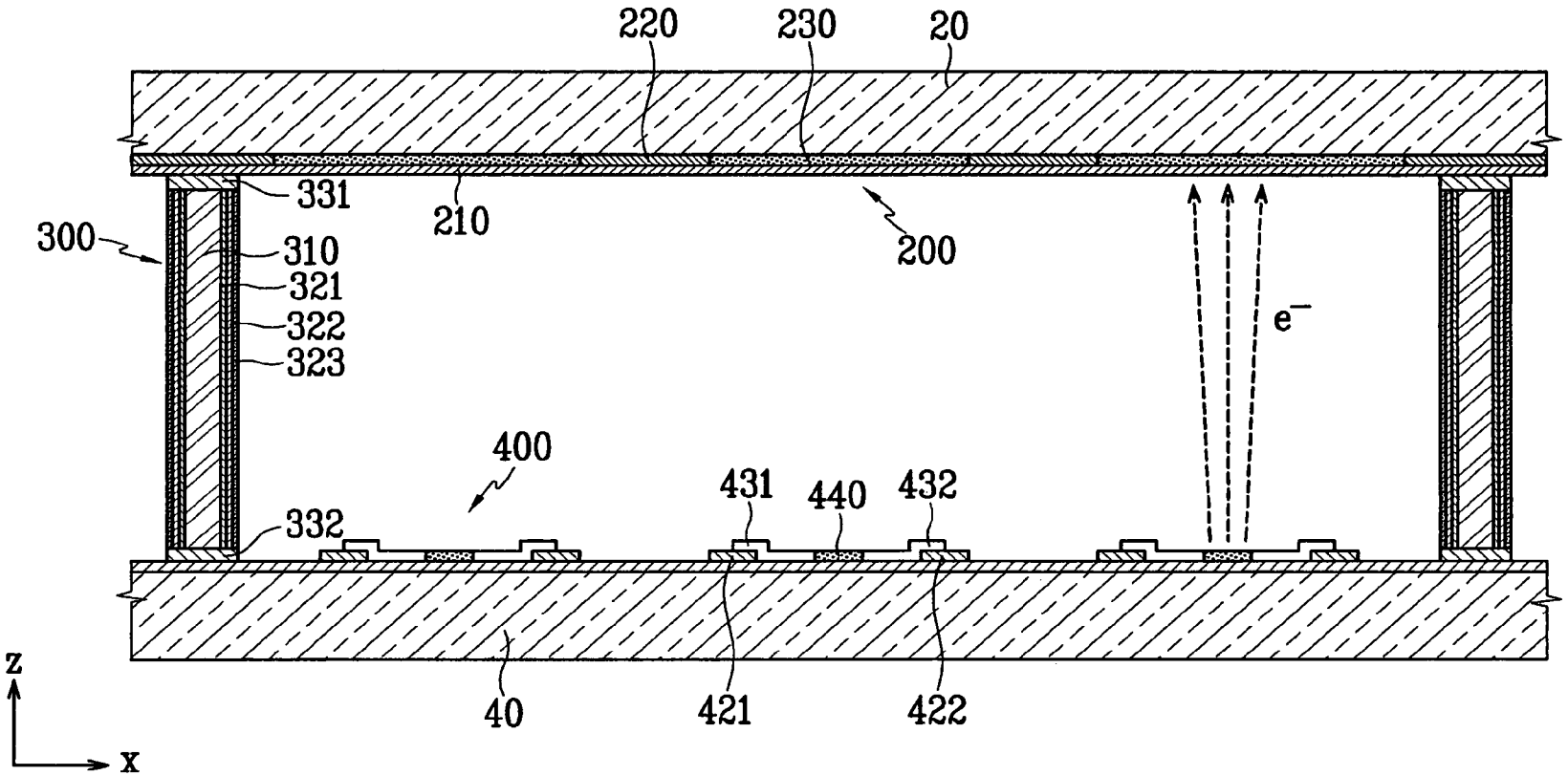
FIG. 3 is a partial sectional view of an electron emission display according to another embodiment of the present invention.

FIG. 3 is a view of an electron emission display having an array of SCE elements, according to another embodiment of the present invention. In this embodiment, parts which are the same as those of the foregoing embodiment have been assigned like reference numerals and a detailed description thereof has been omitted.

Referring to FIG. 3, first and second substrates 40 and 20 face each other and are spaced apart by a predetermined interval. An electron emission unit 400 is provided on the first substrate 40 while a light emission unit 200 is provided on the second substrate 20.

First and second electrodes 421 and 422 are arranged on the first substrate 40 and spaced apart from each other. Electron emission regions 440 are arranged between the first and second electrodes 421 and 422. First and second conductive layers 431 and 432 are respectively arranged on the first substrate 40 between the first electrode 421 and the electron emission region 440 and between the electron emission region 440 and the second electrode 422 while partly covering the first and second electrodes 421 and 422. That is, the first and second electrodes 421 and 422 are electrically connected to the electron emission region 440 by the first and second conductive layers 421 and 422.

In this embodiment, the first and second electrodes 421 and 422 can be formed of a variety of conductive materials. The first and second conductive layers 431 and 432 can be a particle thin film formed of a conductive material, such as Ni, Au, Pt, or Pd. The electron emission regions 440 can be formed of graphite carbon or carbon compound. For example, the electron emission regions 440 can be formed of a material selected from a group consisting of carbon nanotubes, graphite, graphite nanofibers, diamonds, diamond-like carbon, fullerene ($C_{60}$), silicon nanowires, or a combination thereof.

When voltages are supplied to the first and second electrode 421 and 432, current flows in a direction in parallel with surfaces of the electron emission regions 440 through the first and second conductive layers 431 and 432 to realize the surface-conduction electron-emission. The emitted electrons strike and excite the corresponding phosphor layers 210 by being attracted by the high voltage supplied to the anode electrode 230.

According to the present invention, since the spacer includes the resistive layer, secondary electron emission preventing layer, and contact electrode layer, the electric field distortion around the spacer can be prevented and thus the electron beam distortion can be prevented.

Furthermore, since the spacer further includes the diffusion preventing layer arranged between the resistive layer and the secondary electron emission preventing layer, the deterioration of the layer properties due to the surface reaction between the secondary electron emission preventing layer and the resistive layer during the thermal bonding process can be prevented.

As a result, the visible spacer problem where the spacer is observed on the screen by a user can be solved and thus, the display quality of the electron emission display can be improved.

Although exemplary embodiments of the present invention have been described in detail hereinabove, it should be clearly understood that many variations and/or modifications of the basic inventive concept taught herein still fall within the spirit and scope of the present invention, as defined by the appended claims.

What is claimed is:

1. A spacer, comprising: a main body; a resistive layer arranged on a side surface of the main body; a secondary electron emission preventing layer arranged on the resistive layer; and a diffusion preventing layer arranged between the resistive layer and the secondary electron emission preventing layer, the diffusion preventing layer adapted to prevent interdiffusion between the resistive layer and the secondary electron emission preventing layer; wherein the diffusion preventing layer has a resistivity lower than that of the secondary electron emission preventing layer but higher than that of the resistive layer; wherein the diffusion preventing layer comprises a metal oxide layer comprising a material selected from a group consisting of Ti, Zr, and Hf.

2. The spacer of claim 1, wherein the resistive layer comprises a highly resistive material.

3. The spacer of claim 2, wherein the highly resistive material comprises a metal selected from a group consisting of Ag, Ge, Si, Al, W, Au, or an alloy thereof and a compound selected from a group consisting of $Si_3N_4$, AlN, PtN, GeN, or a combination thereof.

4. The spacer of claim 1, wherein the secondary electron emission preventing layer comprises a material having a secondary electron emission coefficient within a range of 1 to 1.8.

5. The spacer of claim 1, wherein the secondary electron emission preventing layer comprises a material selected from a group consisting of diamond-like carbon, $Nd_2O_3$, and $Cr_2O_3$.

6. The spacer of claim 1, further comprising contact electrodes arranged on respective top and bottom surfaces of the main body.

7. The spacer of claim 6, wherein the contact electrodes comprise a material selected from a group consisting of Ni, Cr, Mo, and Al.

8. An electron emission display, comprising: first and second substrates adapted to form a vacuum envelope; an electron emission unit arranged on the first substrate; a light emission unit arranged on the second substrate; and a spacer disposed between the first and second substrates, the spacer including: a main body; a resistive layer arranged on a side surface of the main body; a secondary electron emission preventing layer arranged on the resistive layer; and a diffusion preventing layer arranged between the resistive layer and the secondary electron emission preventing layer and adapted to prevent interdiffusion between the resistive layer and the secondary electron emission preventing layer; wherein the diffusion preventing layer has a resistivity lower than that of the secondary electron emission preventing layer but higher than that of the resistive layer; wherein the diffusion preventing layer comprises a metal oxide layer comprising a material selected from a group consisting of Ti, Zr, and Hf.

9. The electron emission display of claim 8, wherein the resistive layer comprises a highly resistive material.

10. The electron emission display of claim 9, wherein the highly resistive material comprises metal selected from a group consisting of Ag, Ge, Si, Al, W, Au, or an alloy thereof and a compound selected from a group consisting of $Si_3N_4$, AlN, PtN, GeN, or a combination thereof.

11. The electron emission display of claim 8, wherein the secondary electron emission preventing layer comprises a material having a secondary electron emission coefficient within a range of 1 to 1.8.

12. The electron emission display of claim 11, wherein the secondary electron emission preventing layer comprises a material selected from a group consisting of diamond-like carbon, $Nd_2O_3$, and $Cr_2O_3$.

13. The electron emission display of claim 8, further comprising contact electrodes arranged on respective top and bottom surfaces of the main body.

14. The electron emission display of claim 8, wherein the electron emission unit comprises electron emission regions and electrodes adapted to drive the electron emission regions.

15. The electron emission display of claim 14, wherein the electron emission regions comprise a material selected from a group consisting of carbon nanotubes, graphite, graphite nanofibers, diamonds, diamond-like carbon, fullerene ($C_{60}$), silicon nanowires, and a combination thereof.

16. The electron emission display of claim 8, further comprising a focusing electrode arranged between the first and second substrates.

* * * * *